US006004097A

United States Patent [19]

Wark et al.

[11] Patent Number: 6,004,097

[45] Date of Patent: Dec. 21, 1999

[54] COAL MILL EXHAUSTER FAN

[75] Inventors: Rickey E. Wark, The Woodlands, Tex.; John Anthony Nardi, Clinton Township, Mich.

[73] Assignee: Sure Alloy Steel Corp., Madison Heights, Mich.

[21] Appl. No.: 08/938,674

[22] Filed: Sep. 26, 1997

[51] Int. Cl.[6] ..... F04D 29/44

[52] U.S. Cl. ..... 415/206; 416/188; 416/213 R; 416/194

[58] Field of Search ..... 415/196, 206, 415/208.1; 416/236 R, 231 R, 231 B, 237, 245 R, 213 R, 194, 188, 193 R, 229 R, 186 T; 241/79.1; 110/106, 104 R, 101 R

[56] References Cited

U.S. PATENT DOCUMENTS

| | | | |
|---|---|---|---|
| 1,697,202 | 1/1929 | Nagle | 415/206 |
| 2,054,144 | 9/1936 | Swigert | 416/186 R |
| 3,608,976 | 9/1971 | Zugelder | 416/236 |
| 4,236,871 | 12/1980 | Hirst et al. | 416/224 |
| 4,676,717 | 6/1987 | Willyard, Jr. et al. | 415/196 |
| 5,165,859 | 11/1992 | Monroe | 416/224 |
| 5,336,050 | 8/1994 | Guida et al. | 416/213 R |
| 5,363,776 | 11/1994 | Wark . | |
| 5,634,771 | 6/1997 | Howard et al. | 416/229 R |
| 5,810,557 | 9/1998 | Akinkuotu et al. | 416/186 R |

OTHER PUBLICATIONS

International Search Report, International Application No. PCT/US98/20004, Dec. 4, 1998.

*Primary Examiner*—Edward K. Look
*Assistant Examiner*—Richard Woo
*Attorney, Agent, or Firm*—Young & Basile, P.C.

[57] ABSTRACT

An improved coal mill exhauster fan having an elongated, conical hub welded to the blades and engaging the rear shroud plate to eliminate air gaps along the rear of the fan assembly and to assist in axial to radial directional changes of the coal flow; two-piece blade assemblies having a sub-blade welded directly to the hub and shroud plates, and a protective liner removably secured to the sub-blades only, for example by bolts; a plurality of swept-back stiffener ribs welded to the rear undersides of the sub-blades, hub and shroud to increase rigidity, and with angled deflector faces to reduce erosion; and an improved hub cap or spinner seal which extends further toward the housing inlet than traditional Cooley caps and which forms a smooth, non-turbulent extension of the hub relative to the incoming coal flow.

18 Claims, 6 Drawing Sheets

COAL MILL EXHAUSTER FAN

FIELD OF THE INVENTION

The present invention is in the field of coal mill exhauster fans used to draw coal fines from the pulverizer to a combustion chamber or furnace.

BACKGROUND OF THE INVENTION

Coal-fired power plants typically burn pressurized coal/air streams delivered to a fireball in the combustion chamber. The coal/air stream is delivered by a powerful exhauster fan located in series between the combustion chamber and the coal mill or pulverizer, which grinds raw coal into dust-like "fines" for efficient combustion.

An example of a typical pulverizing coal mill is disclosed in U.S. Pat. No. 5,386,619 to Wark.

An example of a prior exhauster fan is disclosed in U.S. Pat. No. 5,363,776, also to Wark. This patent illustrates the pathway from the pulverizer through the fan to the combustion chamber.

Prior exhauster fans, as disclosed in the '776 patent above, typically enclose the fan blades in a housing. The housing has an inlet from the pulverizer directing coal axially into the spinning blades. The blades then redirect the coal radially in the housing, to and through an outlet to the combustion chamber. The blades themselves are heavy, usually rectangular plates of hardened steel or a combination of mild steel with a hardened liner, for example a ceramic liner. The blades are attached to a motorized hub with a strong, heavy "spider" assembly of heavy-gauge steel spokes having angle irons to which the plates are bolted with a dozen or so bolts apiece.

Referring first to prior art FIGS. 1 and 2, a prior art exhauster fan assembly 14 is shown mounted in its housing 10. Housing 10 has an inlet 12 for receiving coal fines which it draws from the pulverizer, and a radial outlet 30 through which the fan throws the coal fines to the combustion chamber. Fan 14 generally comprises a drive hub 16, typically powered via a cantilevered drive shaft 17 by a motor which is coupled simultaneously to the fan and the pulverizer drive. Fan blades 20 are attached to the hub by a spider assembly 18 having a number of integrally formed, spoke-like ribs 18*a*, dual angle irons 18*b* mounted on the end of each rib, and a number of bolts 18*c* used to fasten the plates directly to the angle irons 18*b*. The fan assembly is primarily made from thick steel, reinforced at areas of extra wear, and is extremely heavy. The fan blades 20 themselves, which may measure several feet in length, are typically manufactured from a ⅜" thick hardened steel blade, or a ¼" to 5/16" mild steel blade with a ⅛" to 3/16" hardened ceramic liner.

To reduce turbulence and wear between the fan blades and the housing, illustrated fan 14 may be a "shrouded" fan, in which the blades are enclosed front and back with shrouds 22, 24 (phantom lines) welded or attached via angle iron and bolt structure (not shown) directly to the front and back edges of the blades to form a structurally integral unit. Shrouds 22, 24 are intended to reduce drag and turbulence between the fan blades and the adjacent walls of housing 10. Fan assembly 14 may also be provided with known "whizzer disk" and angle structure 23, 25 in addition to front shroud plate 22.

The front of hub 16 is provided with a conical or flat "Cooley" cap 28 intended to protect the hub and redirect incoming coal fines radially to the fan blades, although in practice it creates turbulence and does not effectively protect fan structure such as the ribs from erosion.

Coal mills often measure efficiency by the pounds per hour of coal fines delivered to the combustion chamber, given a fixed power input to the motor which drives both the exhauster fan and the pulverizer bowl mill. Because the output of the motor is limited, increasing efficiency requires attention to other factors, for example the ability of the fan to provide sufficient flow to keep up with the bowl mill pulverizing action and to prevent ground coal from spilling over the side of the bowl. Alternately, where the air flow provided by the existing fan design is more than sufficient, it may be desirable to reduce the horsepower supplied to the fan to increase the horsepower supplied to the bowl mill, for example where the mill's coal supply is switched from easy-to-grind soft coal to hard coal.

Related factors which affect efficiency or performance, besides the size of the fan blades, are 1) the overall weight of fan assembly 14, which requires more amperage on motor startup and draws more horsepower during operation; 2) erosion and uneven wear of the fan parts, which creates fan imbalances leading to excess vibration, bearing failure, and structural failure of the heavy fan on the end of its cantilevered drive shaft and 3) how easily the fan "breathes" in terms of smooth coal/air flow through the eye of the fan for a given horsepower.

In terms of weight, the standard spider assembly 18 with its angle irons, bolts and heavy ribs and blades is a major power draw on the motor. The angle iron and bolt attachments for the front and back shrouds are also a significant source of weight. Extra weight on the cantilevered fan shaft bearings (not shown) increases the rate of bearing failure. Also, the heavy spider assembly concentrates weight on the very end of the drive shaft and distributes it over a long moment arm radially outward from the drive shaft.

In terms of erosion, the ribs 18*a* of the spider assembly tend to wear significantly, especially toward the center of the fan where the Cooley cap initially diverts the abrasive coal flow into the center of the blades. The unshrouded rear inside edge 20*a* of the fan blades creates turbulence and drag, since air swirls turbulently in this "air gap". Ribs 18*a* additionally obstruct the coal flow as it enters the blade region, further reducing efficiency.

When any of the above-mentioned portions of the fan becomes significantly eroded, the fan must be taken off-line for repairs or replacements, at which point the integral structural connection of the shrouds and the fan blades, and the large number of bolts connecting each fan blade to the spider assembly, make disassembly difficult and time consuming.

Another disadvantage of the prior art spider assembly 18 is the difficulty in assembling and maintaining a symmetrical, balanced fan given the large number of angle irons and bolt-together pieces.

SUMMARY OF THE INVENTION

The present invention is an improved fan assembly which is significantly lighter and stronger, which reduces drag, and which can provide greater cubic feet per minute flow for an equivalent fan blade size, or which can provide higher output static pressure while maintaining or reducing cubic feet per minute. The improved fan assembly can also use thinner, lighter protective liners for the fan blades, and is easier to repair than prior art exhauster fans. In general the improved fan includes an extended, conical hub; a lightweight sub-blade and liner assembly in which the sub-blade is welded to the hub and to the front and back shrouds to form a structural unit, while the liner is bolted to the sub-blade but not welded to the rest of the fan so that it can be easily replaced; and lighter, more erosion-resistant, swept-back ribs individually secured to the hub underneath the blades.

A further feature of the invention is an improved cap for the hub, replacing the traditional Cooley cap with a longer, more steeply angled spinner seal which forms an angular extension of the conical hub.

Yet a further feature of the present invention is a housing inlet extension which complements a modified leading blade angle on the fan assembly, eliminating the need for heavy disk and inlet structure on the fan itself. The diameter of the housing inlet extension is constant and feeds directly into the leading edges of the fan for increased air flow, without pressure drop associated with reduced or venturi-style fan inlet structures, and without the added weight of an inlet-reducing structure on the fan itself.

These and other features and advantages of the present invention are explained in detail below with reference to the accompanying drawings.

DETAILED DESCRIPTION OF THE ILLUSTRATED EMBODIMENT

Figure 3:
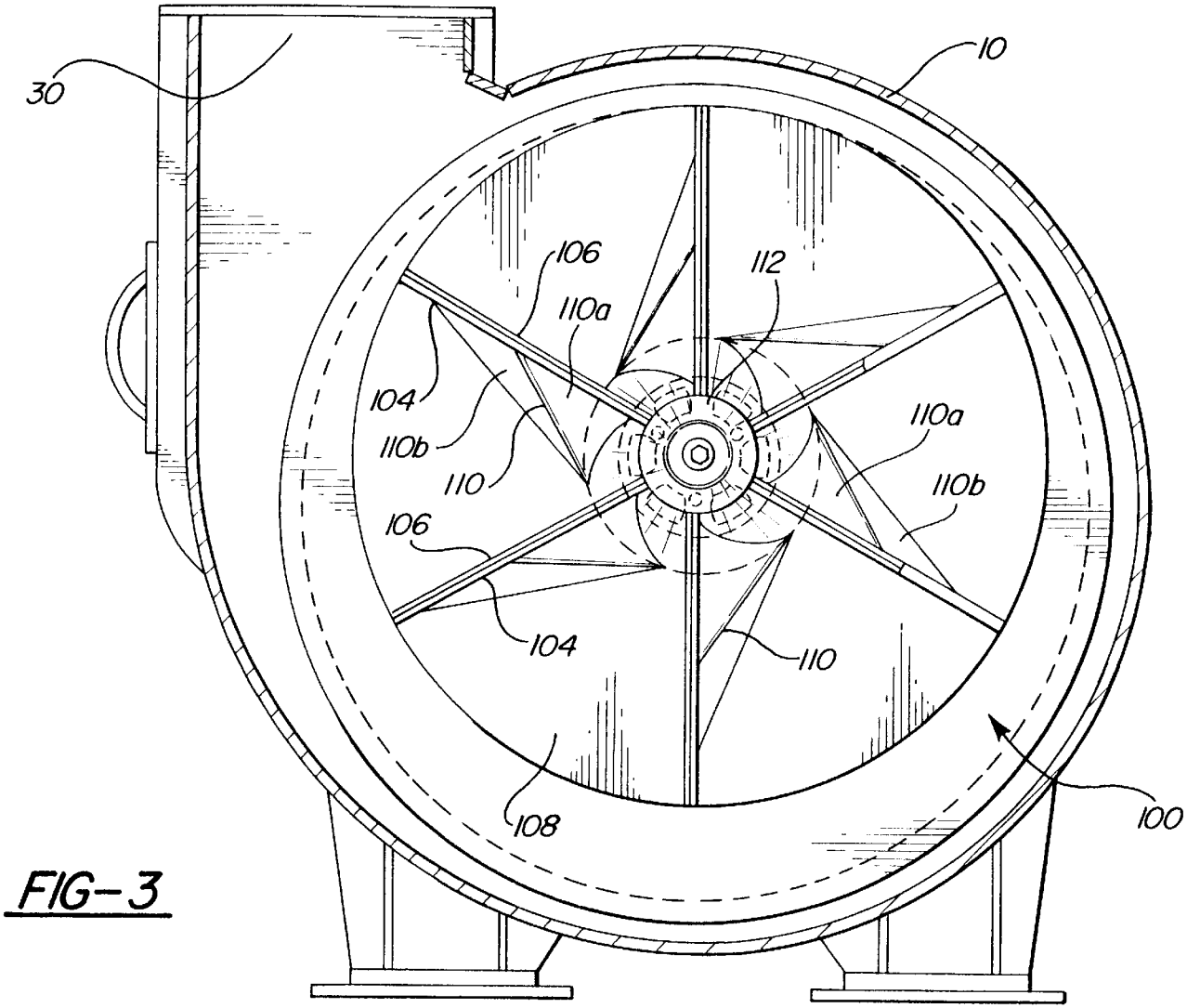
FIG. 3 is a front view of a fan according to the present invention, with the front shroud plate removed.
Figure 4:
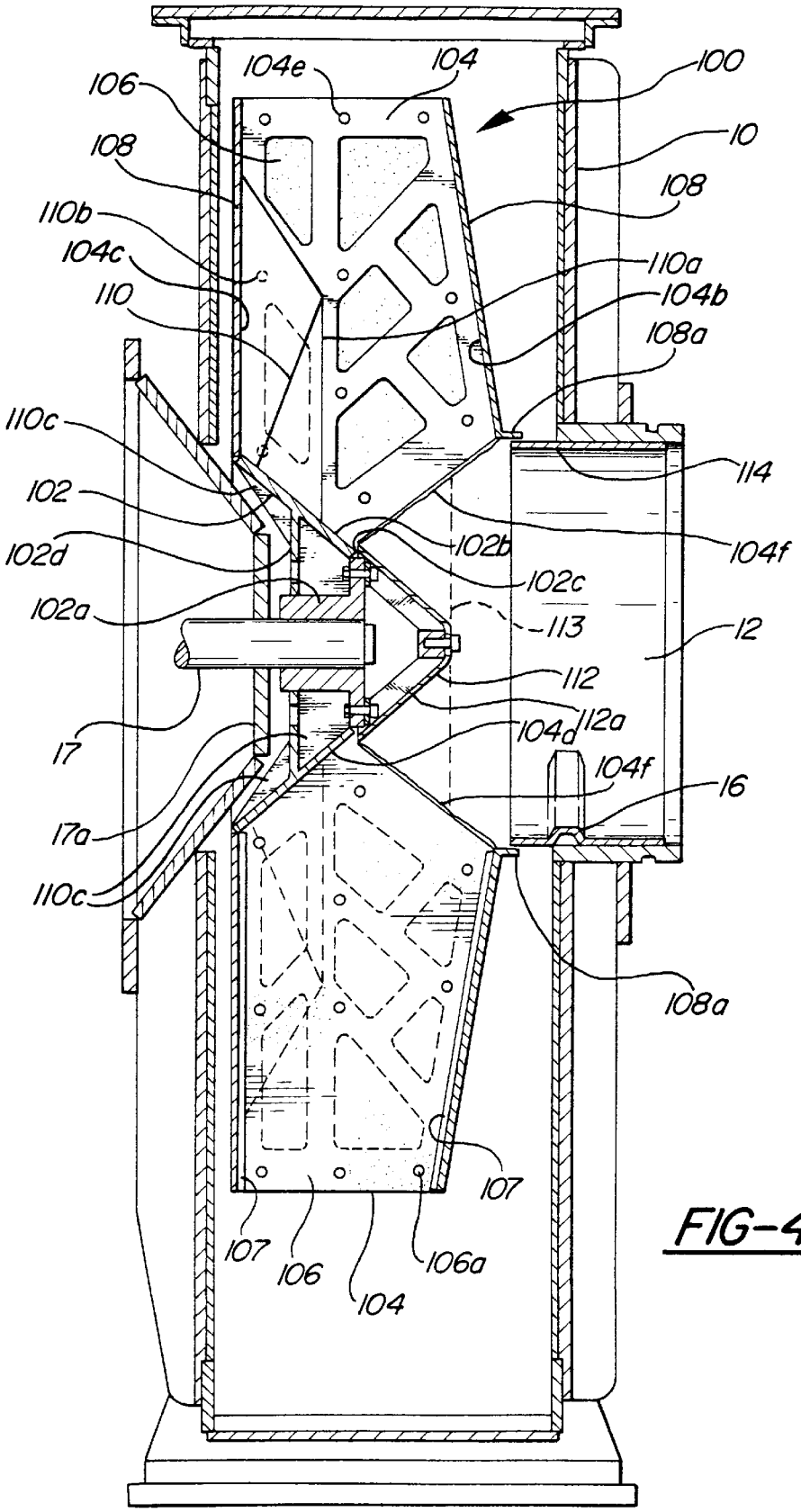
FIG. 4 is a side section view of the fan of FIG. 3.

Referring to FIGS. 3 and 4, a fan assembly 100 according to the present invention is shown in a standard housing 10 which receives coal fines from an inlet 12 and which discharges the coal fines through a radial outlet 30 (best shown in FIG. 3).

Fan assembly 100 is attached to standard, cantilevered-bearing motor drive shaft 17 by a conical, extended hub 102. Motor drive shaft 17 extends through a sealed rear portion 17*a* of the housing to a motor (not shown) of known type, which motor is also typically connected to the coal mill pulverizer drive system. Hub 102 can either be a multi-piece assembly as shown, or integrally cast or machined, as desired. In the illustrated embodiment, hub 102 comprises a central collar 102*a* bolted or similarly mechanically fastened to motor drive shaft 17; a conical sidewall 102*b* attached at its end 102*c* to central collar 102*a*; and optionally a circular slotted disk 102*d* which fits over central collar 102*a* and which can be welded to sidewall 102*b* and collar 102*a*. Whether multi-piece or integrally formed, the above components of hub 102 are preferably formed from steel of sufficient structural strength to handle the dynamic rotational forces known to those skilled in the art, and may be coated with a wear-resistant material.

Fan assembly 100 further includes a plurality of blades 104 welded to the conical sidewall of hub 102 along their inside edges 104*a*. In the preferred form, blades 104 are manufactured from plates of weldable steel, for example ¼ inch or ⅜ inch thick mild or HSLA (high strength, low alloy) steel. Blades 104 are preferably slotted or perforated as shown to reduce weight. The front and rear edges 104*b*, 104*c* of blades 104 are in turn welded to front and back shrouds 108, which are circular plates of steel designed to mate flush with the front and rear edges of the blades on the fan, best shown in FIGS. 3 through 5. The welded connection of blades 104 and shrouds 108 eliminates the weight of the prior art angle iron/bolt connections, and integrates each blade 104 structurally into the fan assembly as a unit.

The elimination of the prior art spider assembly achieved with the elongated conical hub and directly-welded blades of the present invention also moves the fan's center of gravity rearward on the drive shaft toward its bearings, and reduces the moment forces on the shaft by concentrating weight closer to the hub. This is believed to lower the incidence of bearing and hub failure due to stress and cyclic vibration.

Blades 104 can be referred to as "sub-blades" because their leading faces do not contact the coal flow directly. Instead, blades 104 serve as structural bases for thin, lightweight, easily-replaced blade liners 106 which are bolted onto the leading faces of blades 104 by means of bolt holes 104*e* and bolts 106*a*. Blade liners 106 can comprise any hard, abrasion-resistant material known in the art such as high strength alloyed steels, hard-faced steels or other metals, laminates of metal and ceramic, or ceramic. In the illustrated embodiment blade liners 106 are manufactured from a thin, lightweight ceramic plate, for example on the order of 0.25 to 0.50 inches thick.

Because the liners 106 are only attached to blades 104, they are not a structural part of the fan assembly, and accordingly can be replaced without dismantling any other portion of the fan. Although the illustrated embodiment shows bolt-on liners 106, the liners can be fastened to blades 104 in other ways, for example by welding them directly to the blades 104 such that the welds can be mechanically broken when the liner is to be replaced.

A further, optional wear-protecting feature for the blades are wear bars 107 mounted on the upper surface of liners 106 against the junction of the liners with shroud plates 108. Wear bars 107 can be formed as integral upstanding lips on liners 106, or can be formed separately, for example with steel bar stock welded to either the tops of the liners or to the shroud plates.

Figure 1:
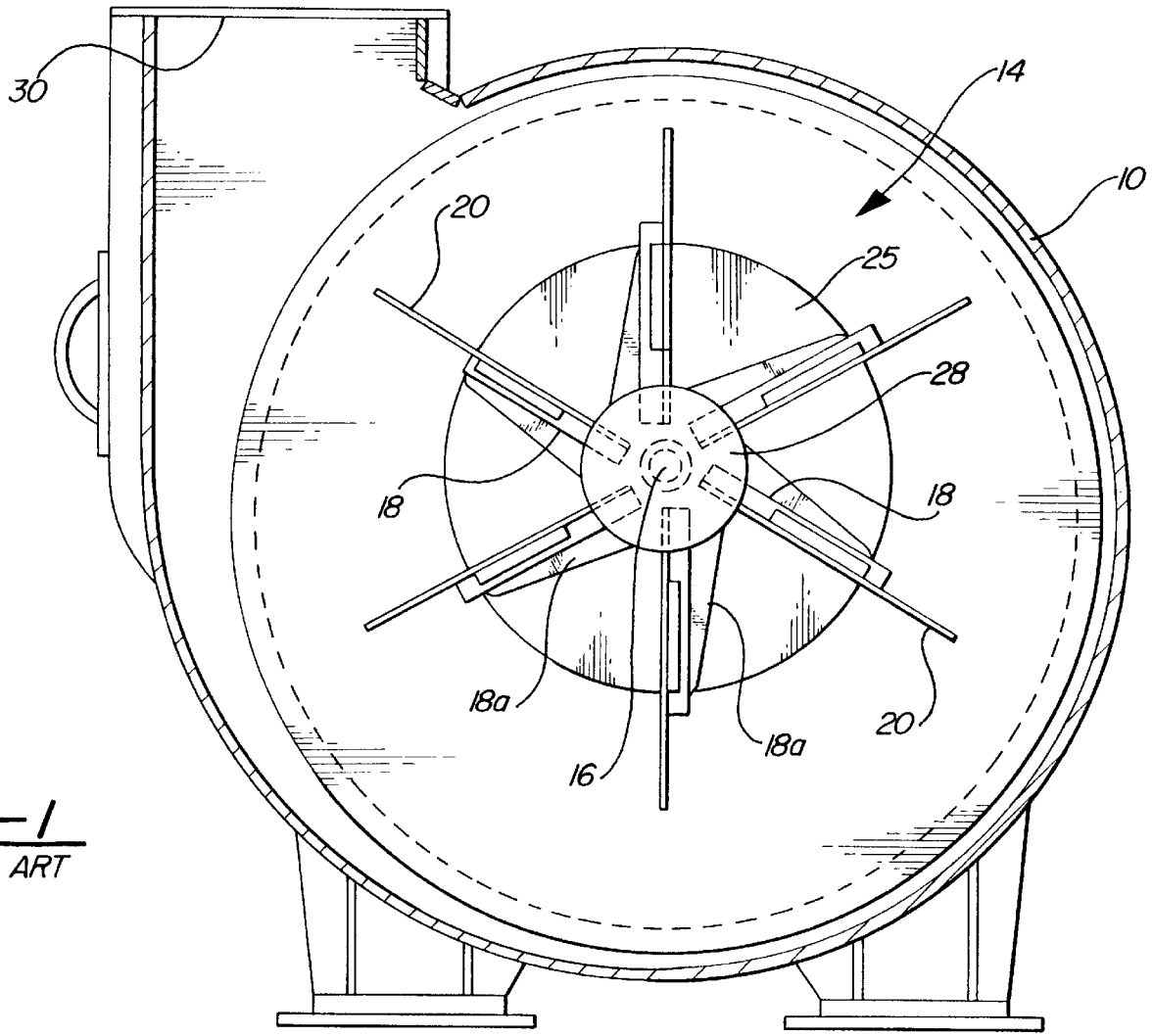
FIG-1 PRIOR ART
FIG. 1 is a front view of a prior art fan with the front shroud plate removed.
Figure 3A:
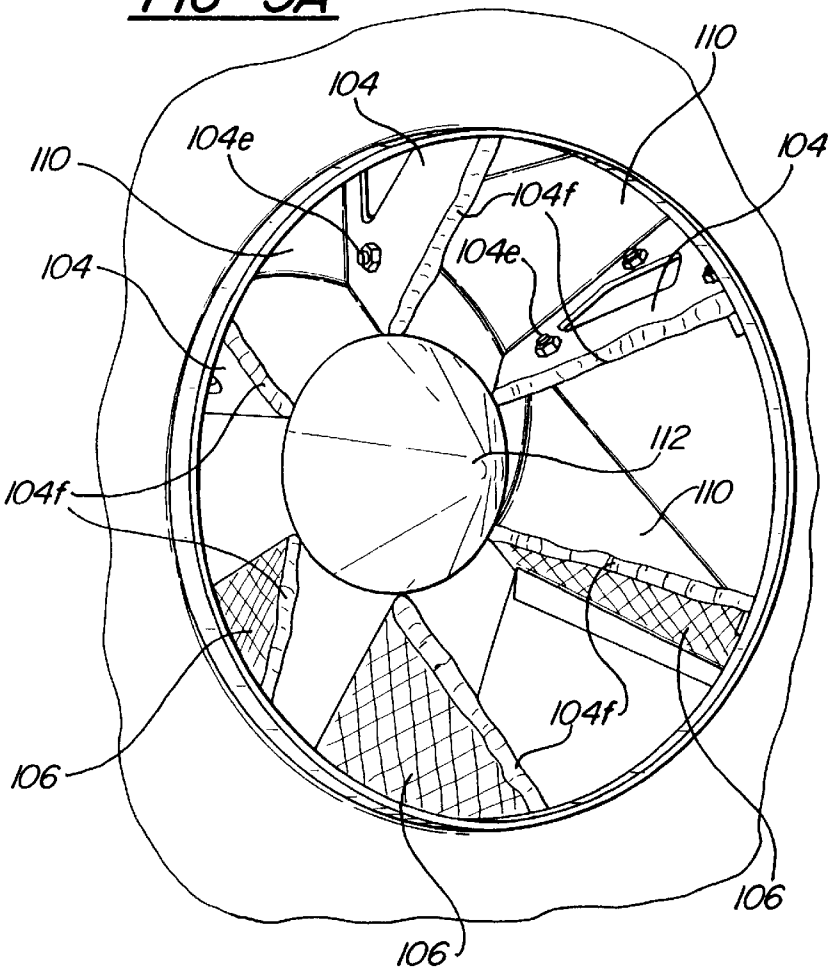
FIG. 3*a* is a front perspective view of the fan of FIG. 3 with the front shroud plate in place.
Figure 1A:
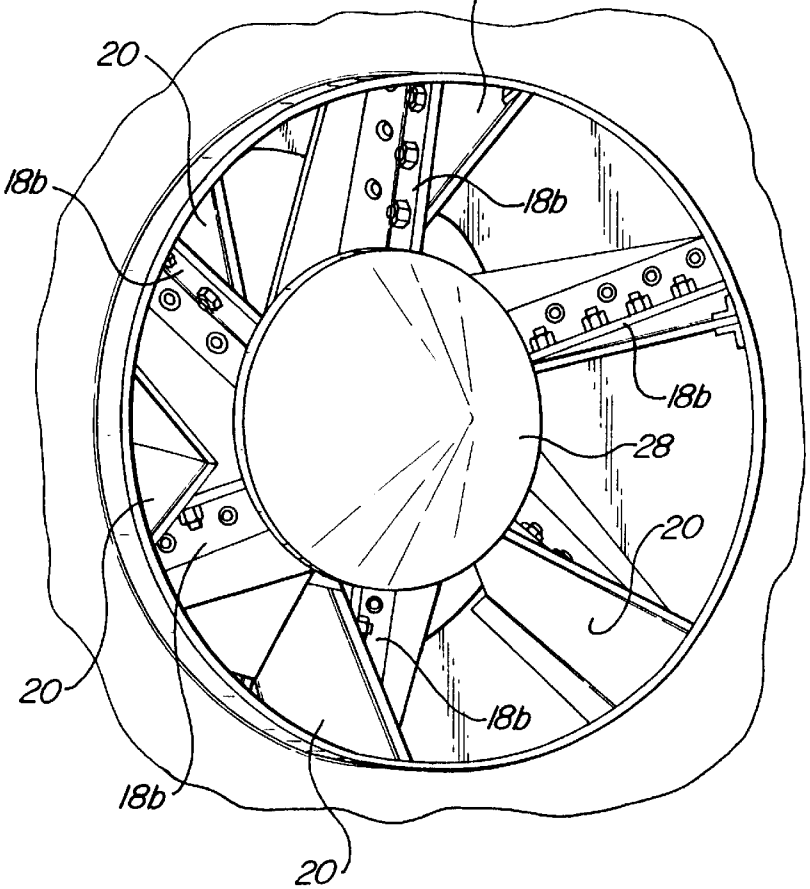
FIG-1A PRIOR ART
FIG. 1*a* is a front perspective view of the prior art fan of FIG. 1 with the front shroud plate in place.
Figure 2:
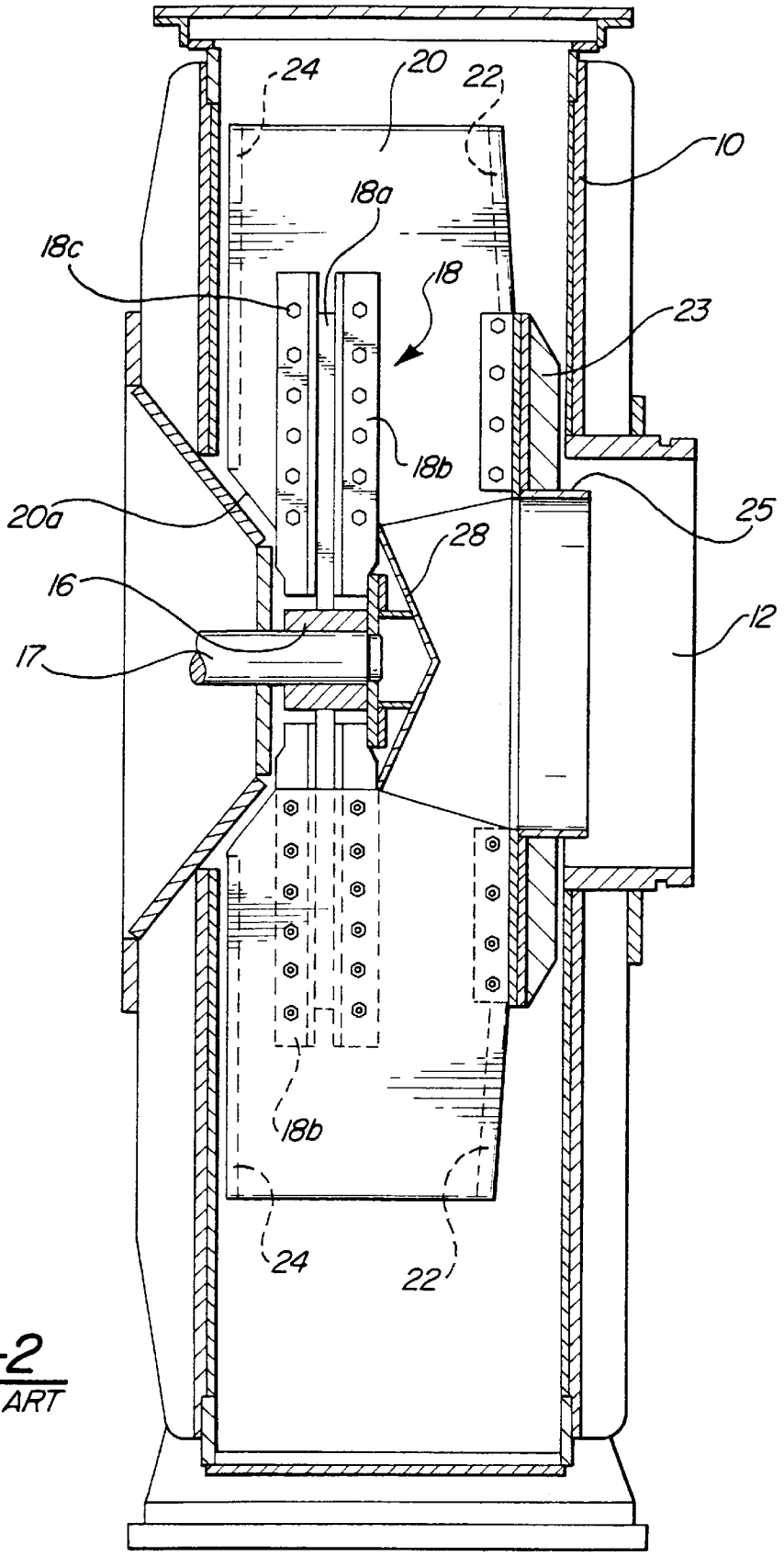
FIG-2 PRIOR ART
FIG. 2 is a side section view of the prior art fan of FIG. 1.

A further feature of the fan blades is the angle of leading edges 104*f*, which in comparison with the prior art blades shown in FIGS. 1 and 2 have a greater angle relative to housing inlet 12, and extend forwardly toward the housing inlet to a point radially outward of the inlet edges. This results in a built-in "waterfall" type relationship between inlet 12 and the leading edges of the fan, with the angle of the leading edges serving to reduce abrasion and to steer the coal fines more rapidly toward the outer ends of the blades.

In the illustrated embodiment, leading edges 104*f* of the blades are protected by a flange or lip 106*b* on the ends of liners 106. It may also be desirable to cover the seam between the hard ceramic blade liner 106 and the softer sub-blade 104 at leading edge 104*f*. Alternately, or in addition to lips 106*b*, the leading edges of sub-blades 104 can be given a coating of wear-resistant material.

FIG. 4 also shows a short fan inlet disk 108*a* attached to or formed on the front shroud plate 108 about the periphery of the fan inlet (defined by the circle of the forward most points of leading edges 104*f*.) Disk 108*a* further helps prevent the loss of coal fines into the turbulent area between the front edges of the fan assembly and the inside front edge of housing 10, where they tend to erode the housing and represent a loss in coal-moving efficiency.

Fan blades 104 are reinforced relative to hub 102 by novel, multi-angled stiffener ribs 110 welded along their edges to the underside of each of blades 104, hub sidewall 102*b* and rear shroud 108. Optional hub-reinforcing internal ribs 110*c* are welded to the inside of the hub underneath disk 102*d*, in alignment with blade ends 104*a* to reinforce the structural tie between the drive shaft, the hub and the blades.

Figure 5:
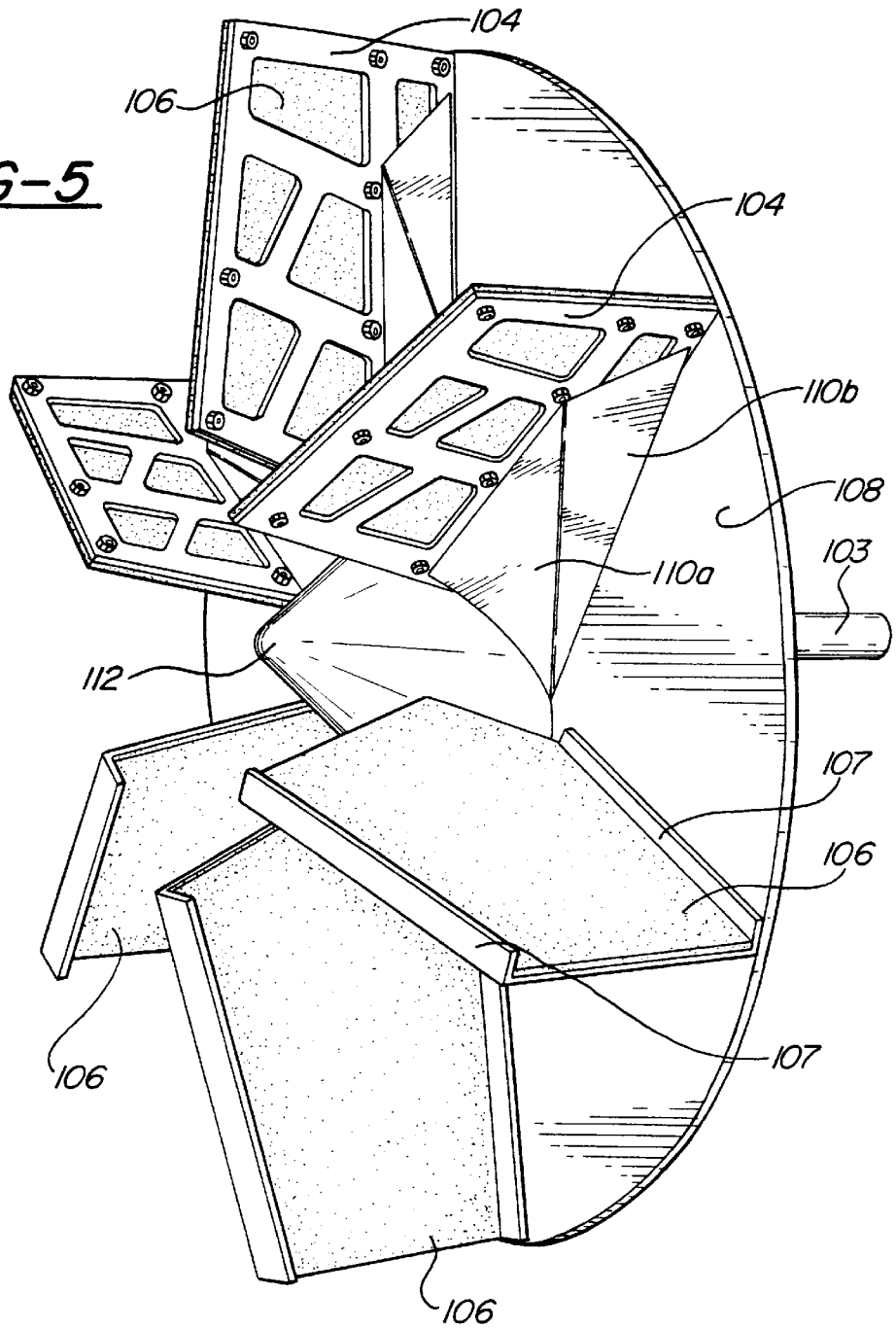
FIG. 5 is a left front perspective view of the fan of FIG. 3 with the front shroud plate removed; and, FIG. 6 is a perspective view of one of the angled stiffener ribs of the fan of FIG. 3.
Figure 6:
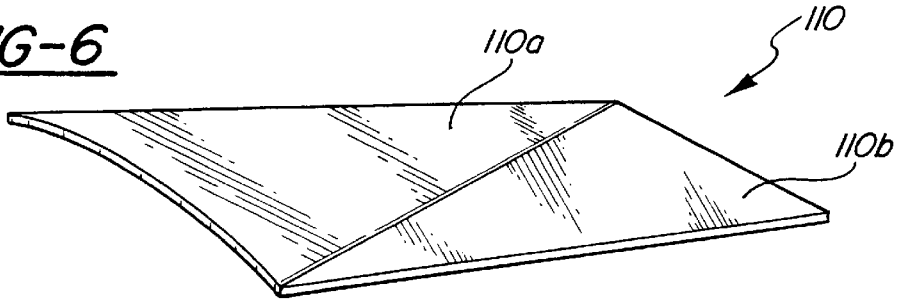

Referring to FIGS. 5 and 6, illustrated rib 110 presents two angled faces to the incoming flow of coal from the fan inlet, a leading face 110*a* and a rear face 110*b*. Leading face 110*a* is swept back and up with respect to the incoming coal flow, while rear face 110*b* is swept back and down, such that rib 110 has something of an inverted V-shaped profile on the blade. This dual-angled, swept-back rib design can be formed from a relatively lightweight steel to reduce the overall weight of the fan as compared to the old spider assembly ribs. The new ribs 110 are also resistant to erosion, due to their deflector-type faces which are presented at an angle to the coal flow. Ribs 110 may optionally be given a wear-resistant coating to further increase abrasion resistance. Ribs 110 additionally reduce wear on other parts of the fan assembly, because their leading faces 110*a* can be extended forwardly over a significant portion of blade 104 and over most or all of the hub.

Angled ribs 110 also help to improve the ability of the fan to "breathe" by smoothing out the transition of the coal/air flow from axial flow (inlet) to radial flow (outlet).

Another advantage of the fan assembly according to the present invention is provided by the extended, conical nature of hub 102. Looking first at FIG. 2, the prior art shrouded fan design leaves an air gap along the inside rear edge 20*a* of fan blades 20, adjacent the rear of the hub. Portion 20*a* of the fan blade, the hub, and the facing adjacent portion of the housing therefore create turbulence. In comparison, the inventive fan assembly (FIG. 4) shows the rear inside edge 104*a* of each blade 104 welded directly to the extended conical sidewall of the hub, which extends to the rear inside edge of rear shroud plate 108, eliminating the air gap and the resulting turbulence in that region.

A further feature of the present invention is the replacement of the prior art Cooley cap 28 with a longer, more steeply angled spinner seal 112 made from a light gauge steel, optionally given a wear-resistant coating. As shown in FIG. 4, spinner seal 112 preferably extends forward toward the fan inlet at least half and preferably more of the lateral distance between the junction of leading edge 104*f* of the blades and hub 102 to the forward most point of the fan blade at disk 108*a*. The distance which spinner seal 112 extends laterally is represented by the dotted line 113 shown in FIG. 4. This extension of the spinner seal toward the inlet results in a more even distribution of the incoming coal flow over the blades, especially over the leading edges of the blades, to reduce wear and increase efficiency. A further feature of spinner seal 112 is the at least flush, and preferably overlapping, alignment of its angled sidewall 112*a* with the sidewall 102*b* and outer end 102*c* of hub 102, making it a smooth, obstruction-free extension of the hub relative to the incoming coal flow. This reduces wear and turbulence in the region of the hub.

Another feature of the present invention is the installation of an extended inlet liner 114 in housing inlet 12. Liner 114 is illustrated as a constant-diameter cylindrical sleeve welded or otherwise secured in inlet 12, extending into the fan housing to lie radially within fan inlet disk 108*a* and leading edges 104*f* of the fan blades to ensure that all of the incoming coal flow is directed smoothly onto the blades without turbulence and with improved distribution of the coal over the surface of the blades. In comparison with the prior art fan assembly of FIG. 2, the increase in the inlet diameter of the fan (as defined by the diameter at the widest point of leading edges 104*f*), and the placing of sleeve 114 on the fan housing rather than the fan assembly, further reduces the weight of the fan assembly and improves coal/air flow through the fan.

Inlet sleeve 114 can include a small "kicker" ramp or bar 116 along a segment of its lower half to kick the larger, heavier pieces of coal which tend to collect in the lower half of the incoming coal stream up toward the center of the fan for a homogeneous mixture and more even distribution in the fan. Kicker 116 further serves to reduce excessive wear on the lower outer edge of sleeve 114, which otherwise would receive a disproportionate flow of heavier, more abrasive coal particles across its surface on the way to the fan. Kicker 116 also helps distribute the coal flow across leading edges 104*f*, directing the flow toward the center of the fan.

The foregoing description is of a preferred, illustrative embodiment. It will be realized by those skilled in the art that modifications can be made to the specific embodiment disclosed without departing from the spirit and scope of the invention as defined by the claims below. For example, the dimensions of the fan assembly in terms of blade width and length; selections of specific wear-resistant materials; the manner in which the structural members of the fan assembly are joined; and other modifications which will depend on the desired operating parameters and environment will be apparent to those skilled in the art now that we have disclosed our invention in detail.

We accordingly claim:

1. An improved coal mill exhauster fan of the type comprising a fan assembly rotating in a housing having an axial coal inlet and a radial coal outlet, the fan assembly comprising a hub attached to rotate with a motorized drive shaft, a plurality of blades attached to the hub, and shroud plates secured to front and rear edges of the blades such that the blades and shroud plates form a structural unit, the improvement comprising an elongated conical hub having a conical sidewall extending to the rear edges of the blades, the rear edges of the blades being radially oriented in alignment with the radial coal outlet, and the blades being welded directly to the conical sidewall of the hub along inside edges of the blades extending from the rear edges of the blades toward the axial coal inlet at an angle parallel to the conical sidewall of the hub.

2. The exhauster fan of claim 1, wherein the conical sidewall of the hub meets the rear shroud plate to eliminate gaps along the rear of the fan assembly.

3. The exhauster fan of claim 1, wherein the blades each comprise a sub-blade welded to the hub and the shroud plates, and a protective liner removably attached to a leading face of the sub-blade.

4. The exhauster fan of claim 3, wherein the leading faces of the sub-blades are perforated to reduce weight.

5. The exhauster fan of claim 3, wherein the protective lines are bolted to the sub-blades.

6. The exhauster fan of claim 1, wherein the blades each comprise a sub-blade welded to the hub and the shroud plates, and a protective liner welded to a leading face of the sub-blade.

7. The exhauster fan of claim 1, wherein the blades have leading edges extending between the hub and the front shroud plate, the leading edges being angled outwardly from the hub at an acute angle to the axial coal inlet to a point radially outward of the housing inlet.

8. The exhauster fan of claim 7, wherein the fan assembly further includes a fan inlet disk on the front shroud plate adjacent the leading edges of the fan blades, the disk extending toward the housing inlet to overlie the inlet.

9. The exhauster fan of claim 1, further including a stiffener rib secured to the hub and an underside of each blade, the rib comprising an angled, swept-back surface.

10. The exhauster fan of claim 9, wherein the rib extends to the rearmost edge of the blade.

11. The exhauster fan of claim 9, wherein the rib comprises two angled deflector faces, the first deflector face being upstream relative to the incoming coal flow and extending rearwardly at a first swept-back angle, the second deflector face being downstream of the first deflector face relative to the incoming coal flow and extending rearwardly at a second swept-back angle.

12. The exhauster fan of claim 11, wherein the second swept-back angle of the rib is a compound angle in which the rib is swept both rearwardly and radially outward with respect to the front deflector face.

13. The exhauster fan of claim 9, further including an internal rib secured to an interior surface of the hub in alignment with the stiffener rib.

14. The exhauster fan of claim 1, wherein the hub includes a removable spinner seal forming an at least flush extension of the conical hub sidewall.

15. The exhauster fan of claim 14, wherein the spinner seal extends laterally toward the housing inlet so as to laterally overlie at least half of a leading edge of the fan blades.

16. The exhauster fan of claim 1, further including a cylindrical inlet sleeve inserted in the housing inlet, the cylindrical inlet sleeve extending into the housing to a point immediately adjacent leading edges of the fan blades, the cylindrical inlet sleeve having a diameter less than the diameter of the leading edges of the fan blades at their widest point.

17. The exhauster fan of claim 16, wherein the cylindrical inlet sleeve includes a kicker portion along a lower surface thereof to deflect coal particles entering the housing along the lower portion of the inlet upwardly toward the center of the fan assembly in the housing.

18. The exhauster fan of claim 1, wherein a rear-most portion of the blades is welded to a rearmost portion of the hub, and wherein a stiffener rib is welded to the rearmost portion of the blade and the rearmost portion of the hub, such that the center of mass of the fan assembly is concentrated on the hub.

* * * * *

UNITED STATES PATENT AND TRADEMARK OFFICE

CERTIFICATE OF CORRECTION

PATENT NO. : 6,004,097

DATED : December 21, 1999

INVENTOR(S) : Wark et al.

It is certified that error appears in the above-identified patent and that said Letters Patent is hereby corrected as shown below:

Column 5, line 15, after "up" insert --(away from the surface of shroud 108)--.

Column 5, line 16, after "down" insert --(toward the surface of shroud 108)--.

Column 7, line 5, delete "housing" and insert --axial coal--.

Column 7, line 9, delete "housing" and insert --axial coal--.

Column 7, line 14, delete "rearmost" and insert --rear--.

Column 7, line 25, delete "front" and insert --first--.

Column 7, line 26, delete "9" and insert --1--.

Column 7, line 28, delete "stiffener rib" and insert --inside edge of each blade--.

Column 8, line 5, delete "housing" and insert --axial coal--.

Column 8, line 9, delete "housing" and insert --axial coal--.

Column 8, lines 20-21, delete "a rear-most portion of".

Column 8, line 21, before "blades" insert --inside edge of each of the--.

Column 8, lines 23-24, delete "rearmost portion of the".

UNITED STATES PATENT AND TRADEMARK OFFICE

CERTIFICATE OF CORRECTION

PATENT NO. : 6,004,097

DATED : December 21, 1999

INVENTOR(S) : Wark et al.

It is certified that error appears in the above-identified patent and that said Letters Patent is hereby corrected as shown below:

Please insert the following new claims:

--19. An improved coal mill exhauster fan of the type comprising a fan assembly rotating in a housing having an axial coal inlet and a radial coal outlet, the fan assembly comprising a hub attached to rotate with a motorized drive shaft, a plurality of blades attached to the hub, and shroud plates secured to front and rear edges of the blades such that the blades and shroud plates form a structural unit, the improvement comprising an elongated conical hub having a conical sidewall extending to the rear edges of the blades, the blades being welded to the conical sidewall, and further including a stiffener rib secured to the hub and an underside of each blade, the stiffener rib comprising an angled, swept-back surface, wherein the stiffener rib extends to the rear edge of the blade.--

--20. An improved coal mill exhauster fan of the type comprising a fan assembly rotating in a housing having an axial coal inlet and a radial coal outlet, the fan assembly comprising a hub attached to rotate with a motorized drive shaft, a plurality of blades attached to the hub, and shroud plates secured to front and rear edges of the blades such that the blades and shroud plates form a structural unit, the improvement comprising an elongated conical hub having a conical sidewall extending to the rear edges of the blades, the blades being welded to the conical sidewall, and further including a stiffener rib secured to the hub and an underside of each blade, the stiffener rib comprising an angled, swept-back surface, wherein the stiffener rib comprises two angled deflector faces, the first deflector face being upstream relative to the incoming coal flow and extending rearwardly at a first swept-back angle, the second deflector face being downstream of the first deflector face relative to the incoming coal flow and extending rearwardly at a second swept-back angle.--

UNITED STATES PATENT AND TRADEMARK OFFICE

CERTIFICATE OF CORRECTION

PATENT NO. : 6,004,097

DATED : December 21, 1999

INVENTOR(S) : Wark et al.

It is certified that error appears in the above-identified patent and that said Letters Patent is hereby corrected as shown below:

--21. The exhauster fan of claim 20, wherein the second swept-back angle of the rib is a compound angle in which the rib is swept both rearwardly and radially outward with respect to the first deflector face.--

--22. An improved coal mill exhauster fan of the type comprising a fan assembly rotating in a housing having an axial coal inlet and a radial coal outlet, the fan assembly comprising a hub attached to rotate with a motorized drive shaft, a plurality of blades attached

UNITED STATES PATENT AND TRADEMARK OFFICE

CERTIFICATE OF CORRECTION

PATENT NO. : 6,004,097

DATED : December 21, 1999

INVENTOR(S) : Wark et al.

It is certified that error appears in the above-identified patent and that said Letters Patent is hereby corrected as shown below:

to the hub, and shroud plates secured to front and rear edges of the blades such that the blades and shroud plates form a structural unit, the improvement comprising an elongated conical hub having a conical sidewall extending to the rear edges of the blades, the blades being welded to the conical sidewall of the hub along inside edges of the blades extending from the rear edges of the blades toward the axial coal inlet, wherein the inside edge of each of the blades is welded to a rearmost portion of the hub, and wherein a stiffener rib is welded to each blade and the rearmost portion of the hub, such that the center of mass of the fan assembly is concentrated on the hub.--

Signed and Sealed this

Thirty-first Day of October, 2000

*Attest:*

*Attesting Officer*

Q. TODD DICKINSON

*Director of Patents and Trademarks*